US005994823A

United States Patent [19]

Okamura et al.

[11] Patent Number: 5,994,823

[45] Date of Patent: Nov. 30, 1999

[54] HIGH-PRESSURE DISCHARGE LAMP, TURNING-ON CIRCUIT DEVICE, AND LIGHTING FIXTURE

[75] Inventors: Kazuyoshi Okamura, Yokohama; Kazuiki Uchida, Fujisawa; Takayuki Aoki, Yokosuka, all of Japan

[73] Assignee: Toshiba Lighting & Technology Corporation, Tokyo, Japan

[21] Appl. No.: 08/729,299

[22] Filed: Oct. 10, 1996

[30] Foreign Application Priority Data

Oct. 12, 1995 [JP] Japan ..... 7-264302
Oct. 2, 1996 [JP] Japan ..... 8-261799

[51] Int. Cl.[6] ..... H01J 1/02

[52] U.S. Cl. ..... 313/25; 313/323

[58] Field of Search ..... 313/3, 25, 570, 313/582, 323; 362/234, 253

[56] References Cited

U.S. PATENT DOCUMENTS 2,103,029 12/1937 Davies ..... 313/25

*Primary Examiner*—Michael B Shingleton
*Attorney, Agent, or Firm*—Oblon, Spivak, McClelland, Maier & Neustadt, P.C.

[57] ABSTRACT

A high-pressure discharge lamp includes an external tube, and two luminescent tubes which extend in the tube axis direction in such a manner that one tube twists with respect to the other or vice versa and which are close to each other at least at one end of each tube and are more separate in the middle of the tubes than the ends close to each other.

10 Claims, 9 Drawing Sheets

HIGH-PRESSURE DISCHARGE LAMP, TURNING-ON CIRCUIT DEVICE, AND LIGHTING FIXTURE

BACKGROUND OF THE INVENTION

1. Field of the Invention

This invention relates to a high-pressure discharge lamp, a turning-on circuit device for the high-pressure discharge lamp, and a lighting fixture provided with the high-pressure discharge lamp and turning-on circuit device.

2. Description of the Related Art

To turn on a high-pressure metal-vapor discharge lamp, such as a high-pressure sodium lamp or a metal halide lamp, again after turning off the lamp, it is necessary to wait for the luminescent tube to get cool to such an extent that the vapor pressure of the mercury and sealed luminescent metal in the tube drops, causing the internal pressure to fall below a specific level, because the vapor pressure of the mercury, sealed luminescent metal, and starting gas is higher than normal atmospheric pressure during lighting. For instance, in the case of a high-pressure sodium lamp, the external start type has to wait for about one minute and the internal start type has to wait for about ten minutes as restart times. In the case of a metal halide, it is necessary to wait for as long as more than ten minutes.

Therefore, for example, when electric power fails for a moment, an incandescent lamp or a fluorescent lamp lights up again immediately, whereas it takes longer than ten minutes for the high-pressure metal vapor discharge lamp to recover the full power. Thus, if the high-pressure metal vapor discharge lamps were used to illuminate a road or the inside of a tunnel, it is inconvenient for illumination and also may have a safety problem.

To overcome these disadvantages, a high-pressure sodium lamp designed to house two luminescent tubes in the external tube, electrically connect the two tubes in parallel with each other, and turn on one of the luminescent tubes, has been disclosed in U.S. Pat. No. 4,287,454.

The luminescent tubes in such a high-pressure sodium lamp are supported in such a manner that the two luminescent tubes are arranged in parallel, the both ends of the tubes are supported by support plates, a support rod is inserted between the support plates so as to be in parallel with the luminescent tubes, and the support rod is supported by the stem of the external tube.

This type of high-pressure lamp, however, has a layout where the two parallel luminescent tubes overlap greatly with each other, so that the shade of the adjacent luminescent tube is large during lighting, which decreases the amount of light so much more, affecting the performance of the lamp.

To avoid the overlapping of the luminescent tubes, means for providing two luminescent tubes inclined to the vertical direction so as to cross each other in an X shape has been disclosed in Jpn. Pat. Appln. KOKAI Publication No. 4-218255.

Crossing the two luminescent tubes in an X shape reduces the shade caused by the unlighted luminescent tube, which improves the nonuniformity of light distribution around the lamp axis remarkably. Some lamps of this type, however, undergo a decrease in the luminous flux.

A study of the cause of a decrease in the luminous flux has revealed that although in the discharge lamp, the temperature is generally the highest in the middle of the luminescent tube during lighting, crossing the two lamps in an X shape makes the temperature in the middle of the tube much higher. The reason is that the radiant heat from the lighted luminescent tube hits the other unlighted luminescent tube made of white ceramic and is reflected by the unlighted tube, and then returns to the lighted luminescent tube. The middle of the tube is at high temperatures from the beginning and tends to be at extremely high temperatures because the two luminescent tubes are close to each other. The study also has shown that when the luminescent tube is at extremely high temperatures, the sodium sealed in the luminescent tube as luminescent metal reacts with aluminum, a material forming the luminescent tube bulb, and disappears, with the result that lack of sodium leads to a decrease in the luminous flux.

SUMMARY OF THE INVENTION

The object of the present invention is to provide a high-pressure discharge lamp capable of not only suppressing an excessive rise in the temperature of the luminescent tubes but also lessening the generation of the shade caused by the existence of the unlighted luminescent tube, a turning-on circuit for the lamp, and a lighting fixture provided with the lamp and the turning-on circuit.

The foregoing object is accomplished by providing a high-pressure discharge lamp comprising: an external tube; and two luminescent tubes which extend in the tube axis direction in such a manner that one tube twists with respect to the other or vice versa and which are close to each other at least at one end of each tube and are more separate in the middle of the tubes than the ends close to each other.

DETAILED DESCRIPTION OF THE PREFERRED EMBODIMENTS

Figure 1A:
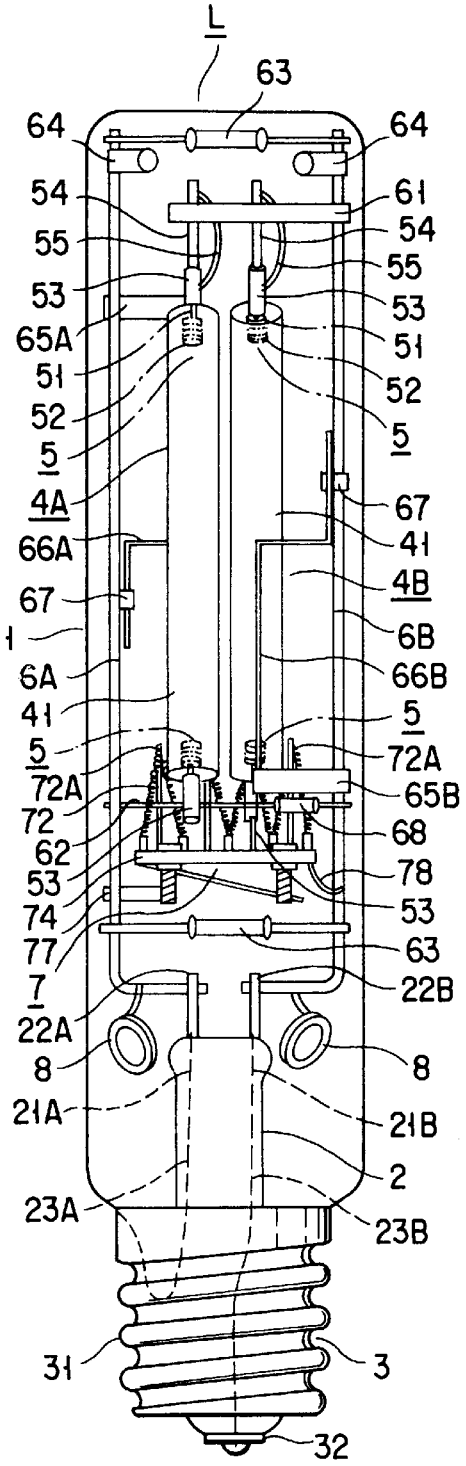
FIG. 1A is a front view of a starter-built-in high-pressure sodium lamp according to the present invention.
Figure 1B:
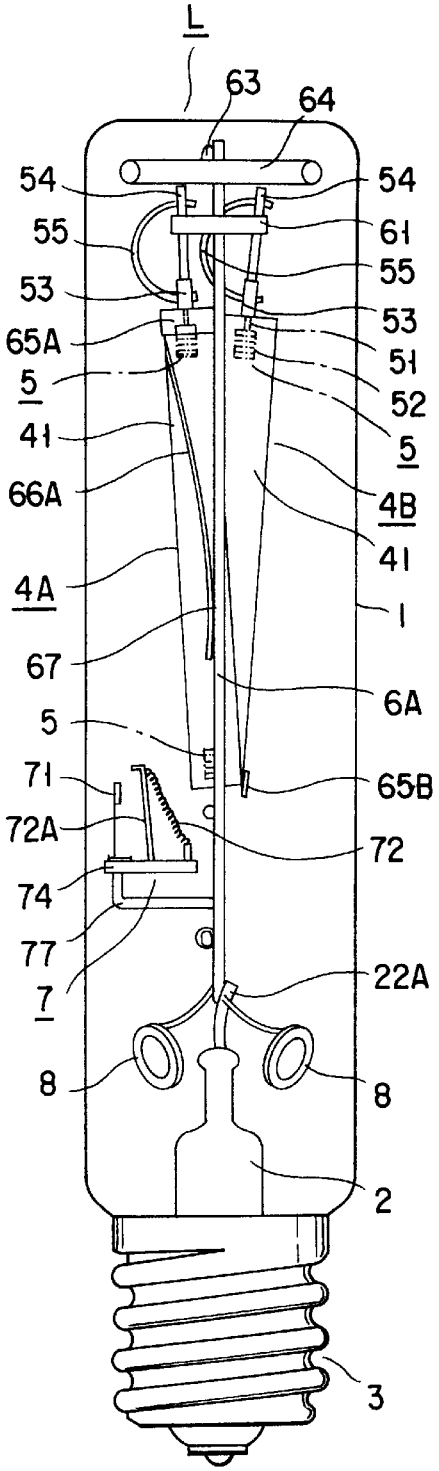
FIG. 1B is a side view of the lamp.
Figure 2:
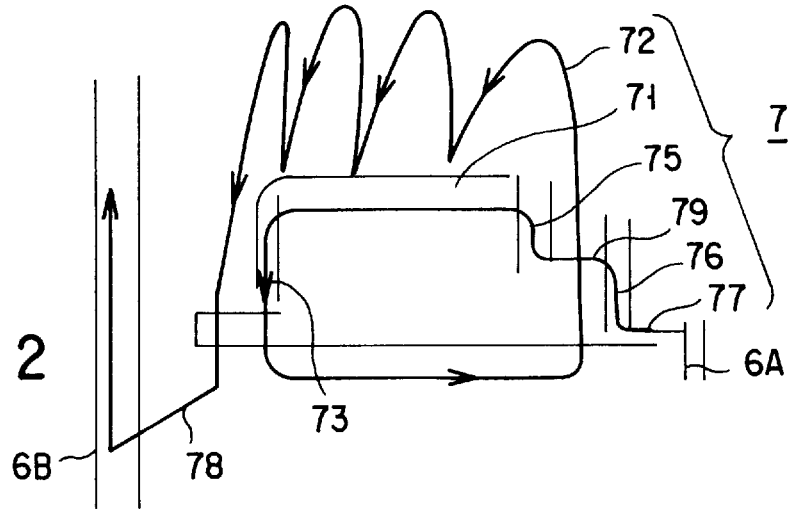
FIG. 2 is a drawing to help explain the flow of current in the starter section in the lamp of FIGS 1A and 1B.
Figure 3A:
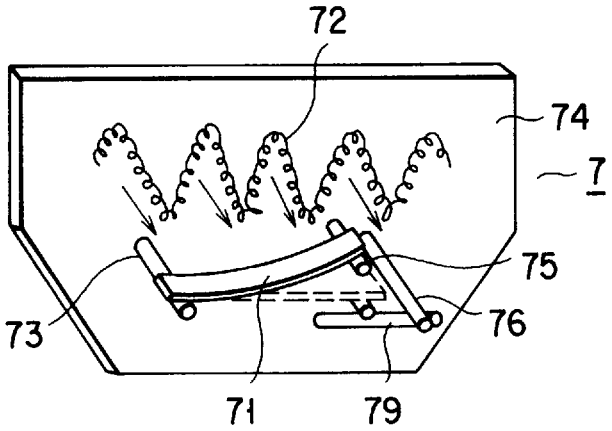
FIGS. 3A and 3B are drawings to help explain the operation of the starter section of the lamp of FIGS. 1A and 1B.
Figure 3B:
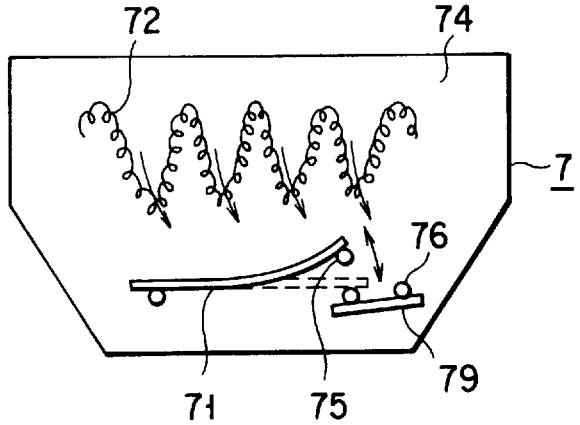

Hereinafter, referring to the accompanying drawings, embodiments of the present invention will be explained. FIGS. 1A and 1B show a high-pressure discharge lamp, such as a starter-built-in high-pressure sodium lamp L, according to the present invention. FIG. 1A is a front view of the lamp and FIG. 1B is a side view of the lamp. FIG. 2 shows the flow of current at the time of starting a lamp L. FIGS. 3A and 3B are drawings to help explain the operation of a bimetal switch.

In FIGS. 1A and 1B, numeral 1 indicates an external tube of the high-pressure sodium lamp L, which is made of hard glass or the like and is formed into a near-straight tube. One end of the tube is closed and the other end has a stem 2 sealed in it. To the sealed portion (not shown), a base 3 having a shell section 31 and an eyelet terminal 32 is attached. The external tube 1 houses two luminescent tubes 4A and 4B in it.

Each of these luminescent tubes 4A, 4B is constructed in such a manner that disc-like end plates made of ceramic or niobium are hermetically joined as closing members to the opening portions at both ends of a bulb 41 composed of a ceramic tube made of, for example, polycrystal aluminum or monocrystal aluminum and electrodes 5, 5 are hermetically bonded to these end plates.

Each of the electrodes 5, 5 is such a known electrode as has a coil section 52 wound around an electrode axis 51 and holds a specific emitter. The electrodes 5, 5 are connected to conductive structures 53, 53 . . . These conductive structures 53, 53, . . . are each forced to project from the end plate at the bulb 41 end. In such a luminescent tube 4 bulb 41, sodium, mercury, and xenon gas are sealed.

As shown in the figure, the luminescent tubes 4A, 4B are arranged in parallel with the axis of the external tube 1 when viewed from the front and are arranged in a near-V shape with an opening angle of about six degrees, with the tubes being close to each other at their lower side and being separate from each other in a twisted manner at their upper side, when viewed from the side. The two luminescent tubes 4A, 4B do not overlap with each other at all when viewed from around the tube axis of the lamp L except that the ends of the two tubes overlap with each other slightly.

In the figure, in the conductive structures 53, 53 located at the top of the luminescent tubes 4A, 4B, respectively, rods 54, 54 made of heat-resistant metal are inserted so as to move freely. The rods 54, 54 are secured to a bulb holder 61 made of heat-resistant metal, such as niobium or tantalum. The bulb holder 61 is mechanically connected to the other support wire 6B. Numerals 55, 55 indicate wires electrically connecting the conductive structures 53, 53 to the rods 54, 54. In the figure, the conductive structures 53, 53 located at the bottom sides of the luminescent tubes 4A, 4B are mechanically connected to one support wire 6A via a bulb holder 62 made of niobium or tantalum. Numeral 68 indicates an insulator for preventing the bulb holder 62 fixed between the support wires 6A, 6B from short-circuiting. The rods 54 have the function of absorbing the thermal expansion and contraction of the bulbs 41 due to the turning on and off of the luminescent tubes 4A, 4B.

The luminescent tubes 4A, 4B having the connection structure as described above are electrically connected in parallel with each other. Specifically, the support wires 6A, 6B are made of conductive wire material and are coupled with each other via the insulator 63 in an insulating manner at the top end and the bottom end. In the vicinity of the top ends of the support wires 6A, 6B, elastic plates 64, 64 that press against the inside face of the external tube 1 are provided.

The bottom ends of the support wires 6A, 6B are welded to internal lead-in wires 22A, 22B connected to the sealed wires 21A, 21B in the stem 2 and are supported by the lead-in wires. External lead-in wires 23A, 23B welded to the other ends of the sealed wires 21A, 21B are connected to the shell section 31 and eyelet terminal 32 of the base 3 by welding or brazing.

Reference symbol 65A indicates a bimetal acting as a thermally movable member for a starting aid conductor, one end of which is secured to the support wire 6A so that its tip may come close to the upper electrode of the luminescent tube 4A. To the tip of the bimetal 65A, one end of a proximate conductor 66A bent into a near-L shape is connected. The proximate conductor 66A is provided in parallel with the luminescent tube 4A from the vicinity of the upper electrode and is bent in the middle so that its tip portion may be supported by a holder 67 located in the middle of the support wire 6A in such a manner that the tip rotates freely.

Similarly, reference symbol 65B indicates a bimetal acting as a thermally movable member for a starting aid conductor, one end of which is secured to the support wire 6B so that its tip may come close to the lower electrode of the luminescent tube 4B. To the tip of the bimetal 65B, one end of a proximate conductor 66B bent into a near-L shape is connected. The proximate conductor 66B is provided in parallel with the luminescent tube 4B from the vicinity of the lower electrode and is bent in the middle so that its tip portion may be supported by a holder 67 located in the middle of the support wire 6B in such a manner that the tip rotates freely.

These proximate conductors 66A, 66B are made of heat-resistant metal, such as niobium or tantalum. The electrode side of each of the proximate conductors 66A, 66B is within 2 mm from at least the tips of the electrodes.

The bimetals 65A, 65B bend due to heat when the corresponding luminescent tubes 4A, 4B come on, which causes the proximate conductors 66A, 66B to rotate so as to separate from the luminescent tubes 4A, 4B. In the state where the proximate conductors 66A, 66B are separated from the luminescent tubes 4A, 4B, the automatic aid function of the proximate conductors 66A, 66B for the luminescent tubes 4A, 4B fails.

A bimetal switch 71 constituting the starter 7 is provided in a position apart from the vicinity of the lower electrodes of the luminescent tubes 4A, 4B. A coiled heater 72 is provided between the bimetal switch 71 and the luminescent tubes 4A, 4B.

One end of the bimetal switch 71 is connected to one end of a metal rod 73. The other end of the metal rod 73 is connected to a support member 74 made up of an insulating material. To the other end of the bimetal switch 71, a rod-shaped switch terminal 75 is connected.

Furthermore, to the support member 74, the bottom end of an L-shaped switch terminal 76 made of metal is connected. The bottom end of the L-shaped switch terminal 76 is supported by the support wire 6A via the holder 77 made of metal. Namely, the support member 74 is also supported by the holder 77. Reference symbols 72A, 72A, . . . indicate anchors that support the heater 72 provided on the support members 74.

The heater 72 is connected to the bottom end of the metal rod 73. The other end of the heater 72 is connected to the support wire 6B via a conductor wire 78.

When electric power is not supplied to the heater 72, the bimetal switch 71 is straight in shape, so that the rod-shaped switch terminal 75 is in contact with the switch section 79 of the switch terminal 76. When electric power is supplied to the heater 72, the bimetal switch 71 deforms in such a manner that it bends toward the heater 72 side. That is, the bimetal switch 71 goes open.

In the figure, numerals 8, 8 indicate ring getters. The inside of the external tube 1 is kept at a high vacuum of about 1/10000 Torr.

Figure 4:
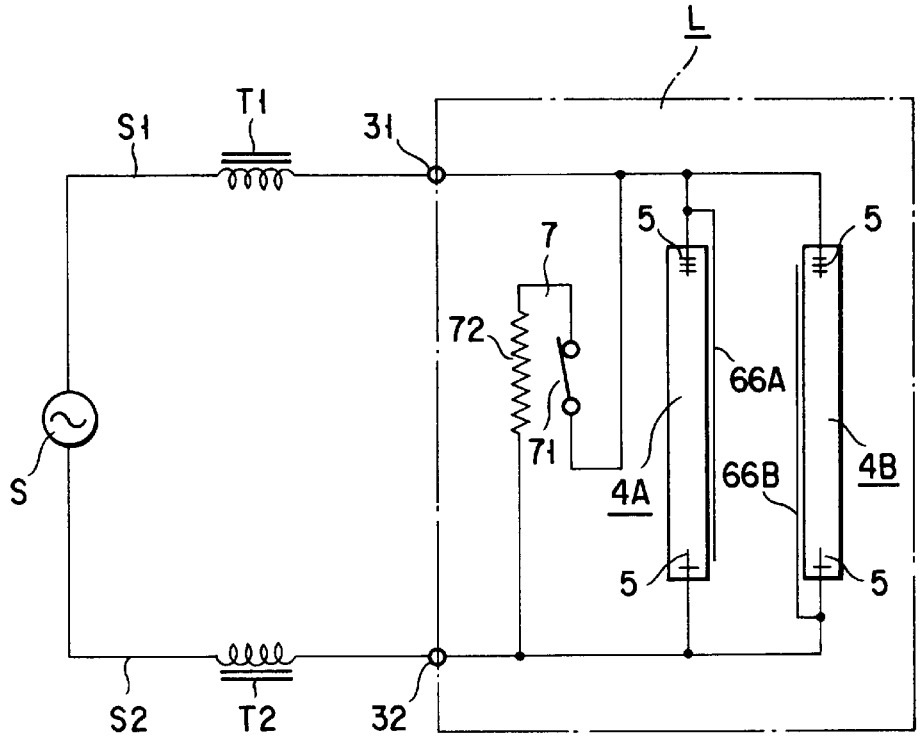
FIG. 4 is a circuit diagram of the turning-on circuit device of a high-pressure sodium lamp according to the present invention.

Next, the operation of the high-pressure sodium lamp L thus constructed will be described by reference to the turning-on circuit device of FIG. 4. In FIG. 4, only the main portion of the lamp L is shown.

In FIG. 4, reference symbol S indicates an alternating-current power supply, S1 and S2 indicate power-supply lines connected to both polarities of the power supply S. The other ends of the power-supply lines S1, S2 are connected to the terminal sections 31, 32 of the base 3 of the lamp L external tube 1 via choke coil ballasts T1 and T2 each having the impedance (both choke coil ballasts have almost the same impedance). In FIG. 4, only the main portion of the lamp L is shown.

In the high-pressure sodium lamp L, the starter 7 is built in the external tube 1 and the two luminescent tubes 4A, 4B in the vicinity of which the proximate conductors 66A, 66B for starting aid are provided symmetrically so that they may be applied with the opposite polarities, are electrically connected in parallel with each other. At the time of start-up, current flows through the support wire 6A, holder 77, switch terminal 76, switch section 79, rod-shaped switch terminal 75, bimetal switch 71, metal rod 73, heater 72, conductor line 78, and support wire 6B, thereby heating the heater 72. When this state continues, the heat of the heater 72 causes the bimetal switch 71 to bend and therefore separate from the switch section 79. At the time when the bimetal switch 71 opens, a kick voltage develops. The pulse caused by the kick voltage is superposed on the alternating-current power supply S via the choke coil ballasts T1 and T2. The generation of the pulse causes either luminescent tube 4A or 4B to come on.

The pulse generated by the starter 7 composed of the bimetal switch 71 and heater 72 produces a positive or negative high-voltage pulse, depending on the positive or negative polarity of the alternating-current power supply S. If start-up is repeated more than several hundred times, the probability that a negative pulse will be applied to the proximate conductors 66A, 66B for starting aid for the luminescent tubes 4A, 4B is about 50%, and consequently the probability that each of the luminescent tubes 4A, 4B will come on is about 50%.

This prevents either the luminescent tube 4A or 4B from being used more frequently, which eliminates the disadvantages that in either the luminescent tube 4A or 4B, sodium disappears more and consequently the lamp voltage rises or the luminescence characteristic deteriorates earlier than expected. This virtually makes the service life twice as long as that of a lamp L housing a single luminescent tube.

When one luminescent tube goes off in a case that electric power fails for a moment during lighting, the other luminescent tube that has been unlighted and has a lower internal pressure comes on as soon as the power failure is corrected. At that time, the other luminescent tube has been heated during the time when one luminescent tube was on and has a little raised internal pressure, so that it reaches the stable lighting state in a short time.

Therefore, the time required to restart the lamp is very short. Use of lamps of this type for illuminating the road or the inside of the tunnel increases safety because the lighting recovers in a short time, even if the lamp goes off for a moment.

When the luminescent tube lights up, this heats the bimetal, which is then deformed, causing the proximate conductors 66A, 66B to separate from the luminescent tubes 4A, 4B, respectively. As a result, the rate at which the proximate conductors 66A, 66B block the light emitted from the luminescent tube is decreased.

The luminescent tubes 4A, 4B overlap with each other at the lower end portions in FIGS. 1A and 1B. The portion closer to the end than the electrode 5 of the luminescent tube 4A is away from the discharging path and has a smaller amount of luminescence than the middle portion. Therefore, when one luminescent tube 4A in the lamp L comes on, the unlighted luminescent tube 4B blocks the light only a little, which helps reduce the nonuniformity of light distribution around the tube axis of the lamp L. Consequently, it is possible to provide a long-service-life, high-pressure sodium lamp L that has neither loss of radiant light in the middle of the luminescent tube 4A where the amount of luminescence is the largest nor an excessive rise in the temperature of the luminescent tube 4A due to proximity to each other in the middle of the tubes, suppresses the reaction between aluminum (the material of bulb 11) and sodium (the luminescent metal) prevents sodium from disappearing, and permits only a smaller rise in the lamp glow starting voltage and a smaller drop in the luminous flux.

It is desirable that the two luminescent tubes arranged in a near-V shape should be crossed or made close to each other at a position where the light output is lower than the middle portion in such a manner that the proximate portion of one tube is not beyond the tip of the electrode of the other tube. Below the position, the loss of luminous flux is smaller and the area of the shade is smaller.

Table 1 and table 2 show the nonuniformity of light distribution for the lamp L (shaped like a V) whose structure is such that the luminescent tubes 4A and 4B come closer to each other at the ends in FIGS. 1A and 1B and for the lamp L (shaped like an X) whose structure is such that the luminescent tubes 4A, 4B cross each other in the middle, In table 1, the nonuniformity of light distribution directly under the lighting fixture is compared, with the opening angle that the lighted luminescent tube and the unlighted luminescent tube form being about six degrees. Table 2 shows the comparison of the luminous flux of lamp L of a V shape with lamp L of an X shape, provided that the luminous flux of lamp L of an X shape is 100%.

TABLE 1

| | Relative light intensity | |
|---|---|---|
| Angle | Present invention (V shape) | Prior lamp (X shape) |
| 0 | 100 | 100 |
| 45 | 100 | 100 |
| 90 | 100 | 100 |
| 135 | 97 | 98 |
| 180 | 94 | 93 |
| 225 | 96 | 97 |
| 270 | 100 | 100 |
| 315 | 100 | 100 |

TABLE 2

| Relative light flux | |
|---|---|
| Present invention (V shape) | Prior Lamp (X shape) |
| 123 | 100 |

As seen from table 1 and table 2, the lamp L according to the present invention not only reduces the nonuniformity of light distribution but also improves the luminous flux.

Furthermore, it is desirable that in the high-pressure sodium lamp L constructed as shown in FIGS. 1A and 1B, the bimetal 65A connected to the proximate conductor 66A of, for example, the unlighted luminescent tube 4A should be placed close to the external tube 1 of the bulb 41 of the luminescent tube 4A. The reason is that the bimetal 65A located in a place where the temperature is lower than that of the other portions apart from the other luminescent tube 4B is close to the luminescent tube 4A, so that it is possible to turn on the luminescent tube 4A reliably by superposing a pulse across the luminescent tube 4A at the time of restart-up, even if the luminescent tube 4B dies out at the end of the service life. When the bimetal 65A is close to the other luminescent tube 4B and is heated much by this lighted tube, it separates away from the luminescent tube 4B, in which case, the luminescent tube 4A does not always come on at the time of restart-up, resulting in the disadvantage that the luminescent tube 4B is lighted again and dies out. Furthermore, since the heater 72 of the starter 7 has a great thermal effect on the bimetal 65B connected to the proximate conductor 66B of the luminescent tube 4B provided close to the starter 7, it is favorable that the bimetal 65B should be provided on the bulb 41 surface of the luminescent tube 4B on the opposite side. With the bimetal provided this way, the repetitious operation of the starter 7 at start up causes the bimetal 65B to be deformed by the heat from the heater 72 and separated from the luminescent tube 4B, which prevents the ignition voltage of the luminescent tube from rising.

Figure 5A:
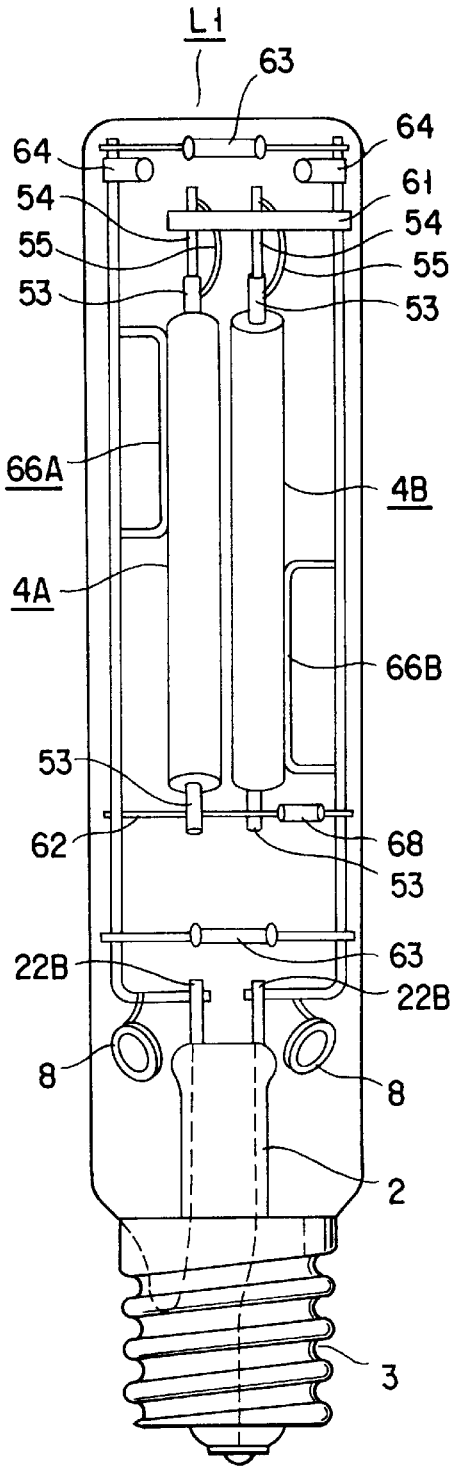
FIG. 5A is a front view of another high-pressure sodium lamp according to the present invention.
Figure 5B:
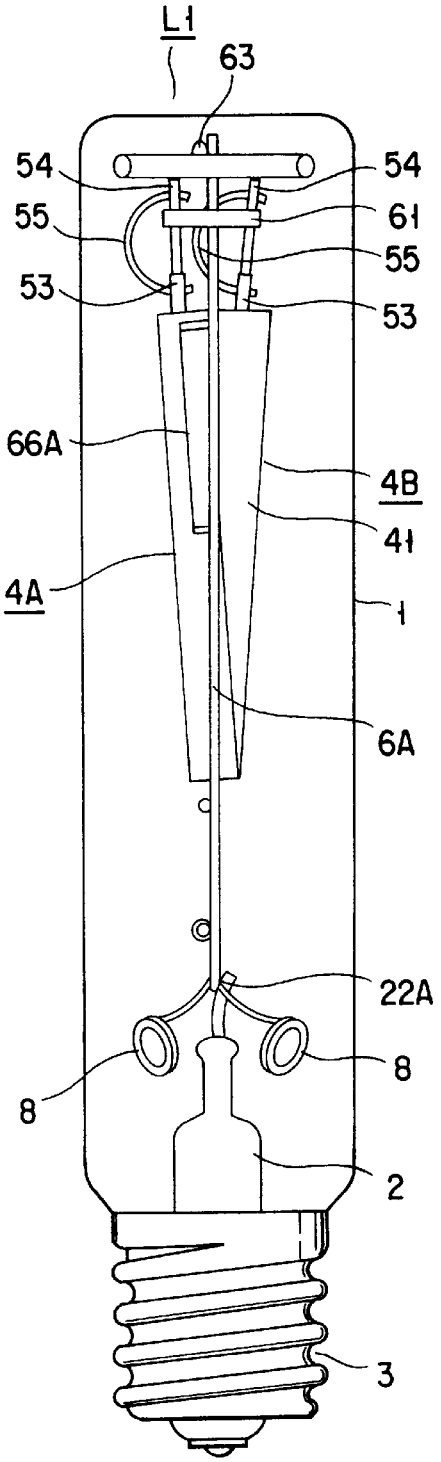
FIG. 5B is a side view of the lamp.

FIGS. 5A and 5B show a high-pressure discharge lamp L1 according to another embodiment of the present invention. The same parts as those in FIGS. 1A and 1B are indicated by the same reference symbols and explanation of them will be omitted. The high-pressure discharge lamp L of FIGS. 1A and 1B is a starter-built-in lamp L provided with the starter 7 composed of the bimetal switch 71 in the external tube 1. A lamp L1 14 shown in FIGS. 5A and 5B, however, does not have any starter inside the external tube 1, but is externally provided with an starter. The lamp L1 is connected to, for example, a turning-on circuit device shown in FIG. 6, which turns on the lamp. Proximate conductors 66A, 66B are of the fixed type that does not have the bimetals connected to the support wires 6A, 6B.

Figure 6:
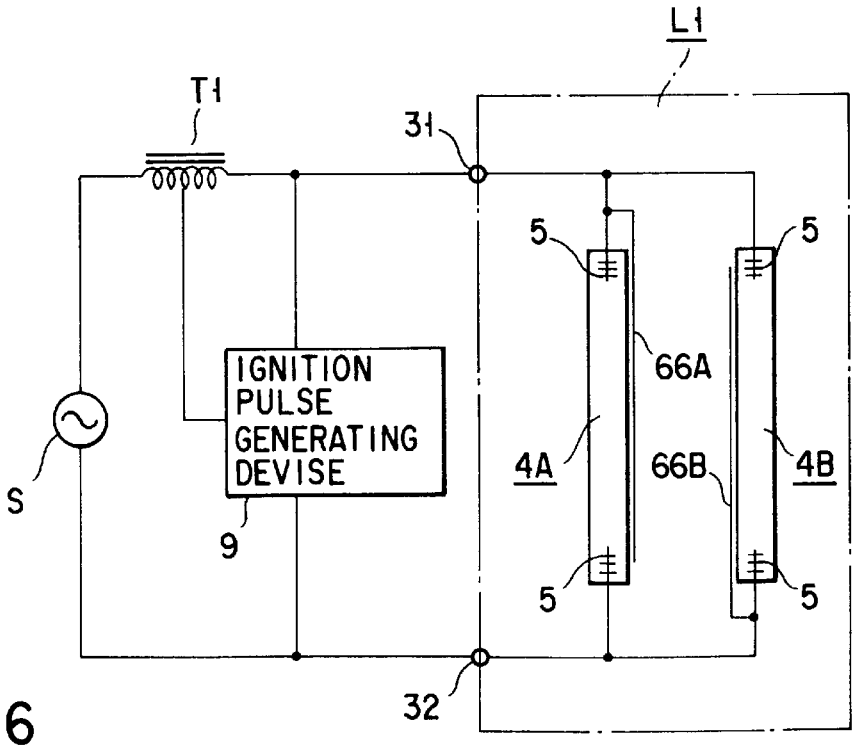
FIG. 6 is a circuit diagram of another turning-on circuit device of the high-pressure sodium lamp according to the present invention.

In the turning-on circuit device of FIG. 6, a single choke coil ballast T1 is connected to an alternating-current power supply S and a starter 9 that functions as a starting pulse generator in connection with the choke coil ballast T1. Specifically, in the present embodiment, the operation of the starter 9 acting as a starter pulse generator generates pulse voltages on both sides of the choke coil ballast T1. The starting pulse generator may have a separate pulse transformer the output of which is applied to the lamp L1.

The turning-on circuit device is designed to superpose the pulse generated at the choke coil ballast T1 by the operation of the starter 9 acting as the starting pulse generator on the alternating-current voltage from the alternating-current power supply S and apply the resulting voltage to the lamp L1.

In this case, a high-voltage pulse is applied to the positive and negative alternating-current voltages. That is, the starting pulses are generated alternately every half cycle. In the lamp L1, the luminescent tube on the proximate conductor side is apt to start glowing when a negative pulse is applied to either the proximate conductor 66A or 66B. Therefore, for instance, when a positive pulse is applied to the eyelet terminal 32 of the base 3, one proximate conductor 66A is made negative in potential, causing the luminescent tube 4A close to this proximate conductor to start glowing.

Conversely, when a positive pulse is applied to the shell section 31 of the base 3, the other proximate conductor 66B is made negative, causing the luminescent tube 4B close to this proximate conductor to start glowing.

As described above, the probability that a positive pulse will be applied to the proximate conductor 66A or 66B is 50% and consequently the probability that each of the luminescent tubes 4A and 4B will start to glow is 50%.

The probability of the luminescent tube 4A starting to glow and that of the luminescent tube 4B starting to glow are leveled as the number of times the luminescent tubes are turned on increases. As a result, neither the luminescent tube 4A nor 4B is started more intensively. Furthermore, even if a momentary power failure occurs during lighting, the luminescent tube that has been off up to that time will start to glow. The present embodiment, therefore, produces the same effect as the above embodiment.

Figure 7A:
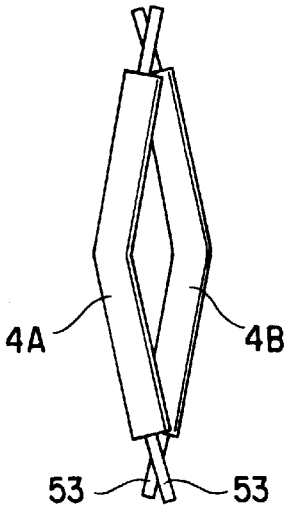
FIGS. 7A and 7B are front views to explain the rough layout of the luminescent tubes in another high-pressure discharge lamp according to the present invention.

FIGS. 7A to BB each show another embodiment of the luminescent tubes in a high-pressure discharge lamp according to the present invention. The same parts as those in FIGS. 1A and 1B and FIGS. 5A and 5B are indicated by the same reference symbols and explanation of them will be omitted.

These embodiments differ from the above embodiments in the configuration of the bulb 41 section of the luminescent tubes 4A, 4B, so only the portions of the luminescent tubes 4A, 4B are shown.

Figure 7B:
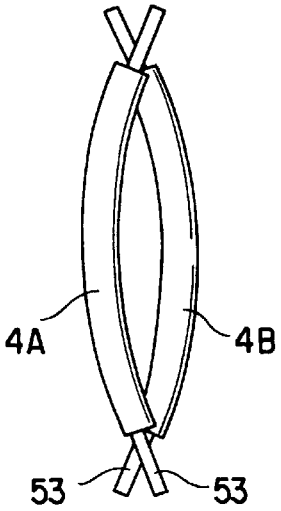

In FIG. 7A, bulbs 41 are bent in the middle to form near-dogleg luminescent tubes 4A, 4B and the top and bottom ends are placed close to each other so that the tubes may form a near-rhombus. In FIG. 7B, bulbs 41 are curved to form arc-shaped luminescent tubes 4A, 4B and the top and bottom ends are placed close to each other so that the tubes may form a near-O shape. The luminescent tubes may be crossed to form a near-V shape or to form an X shape, when viewed from the side. Although the two luminescent tubes 4A, 4B of the same shape are combined, the tubes of different shapes may be combined. For instance, a straight tube may be combined with a near-dogleg tube.

Figure 8A:
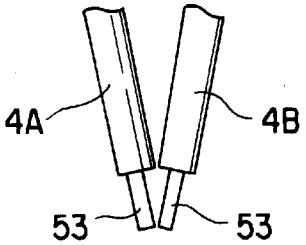
FIGS. 8A and 8B are side views to explain the rough layout of the important portions of the luminescent tubes in another high-pressure discharge lamp according to the present invention.
Figure 8B:
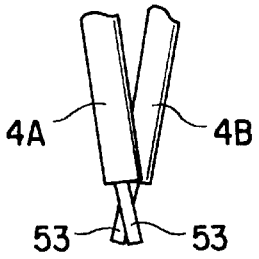
Figure 13:
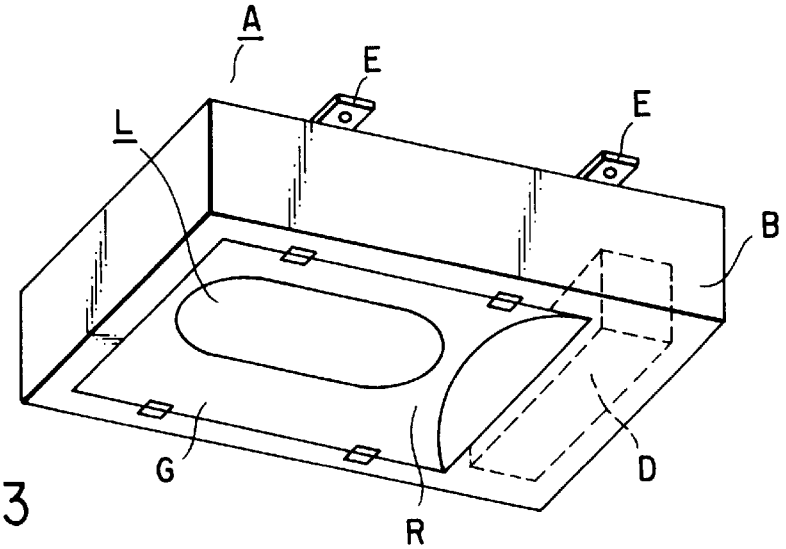
FIG. 13 is a perspective view of a lighting fixture according to the present invention.

Specifically, the luminescent tubes have only to be arranged in such a manner that their ends are placed close to each other to form a near-reversed V shape or are crossed a little to form a near-V shape as shown in the side views of FIGS. 8A and 8B so that the luminescent tubes 4A, 4B may be combined in a place apart from the middle portion where the shade is greater, in order to make the shade smaller when the luminescent tubes 4A, 4B are viewed in any direction. The greater the distance between the luminescent tubes 4A and 4B, the smaller the area of the shade. A larger distance between the luminescent tubes makes the size of the lamp greater, so decision should be made taking into account these two factors.

Figure 9:
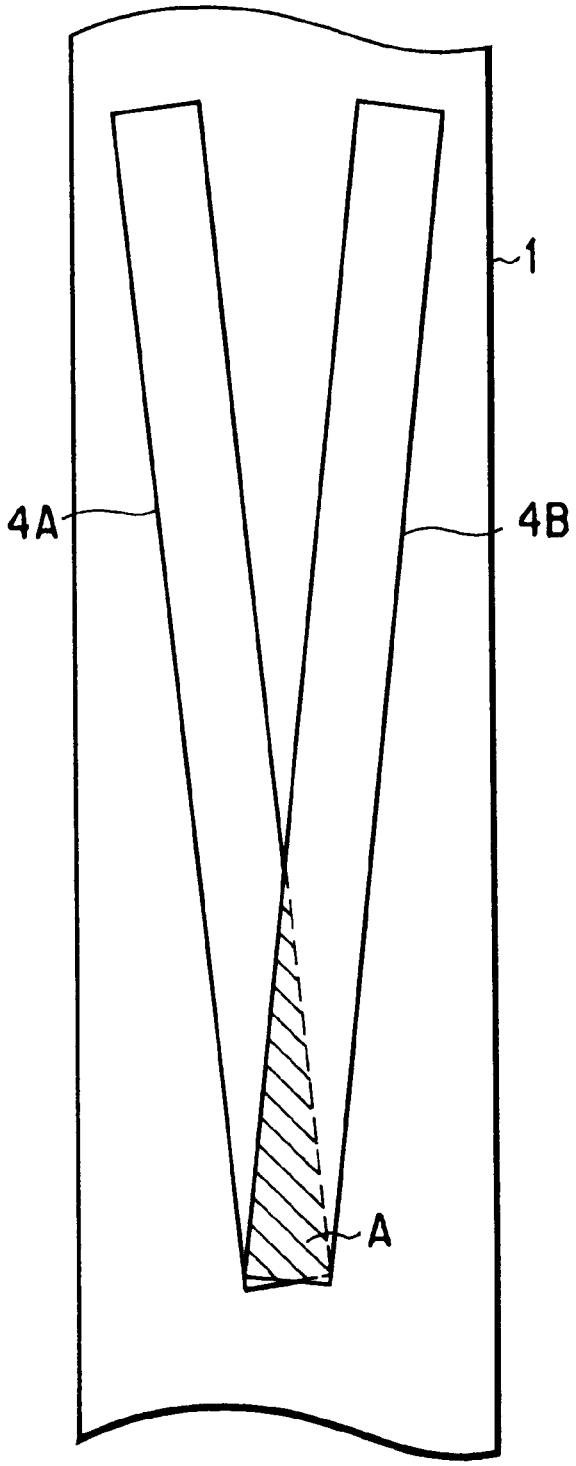
FIG. 9 is a diagram illustrating the overlapping parts of the two luminescent tubes.
Figure 10A:
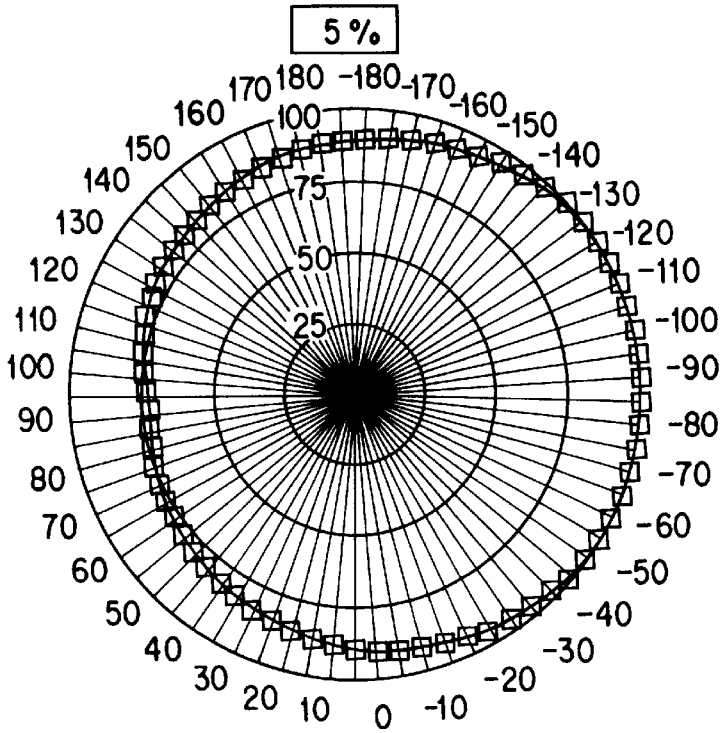
FIGS. 10A and 10B show data representing the light distribution.
Figure 10B:
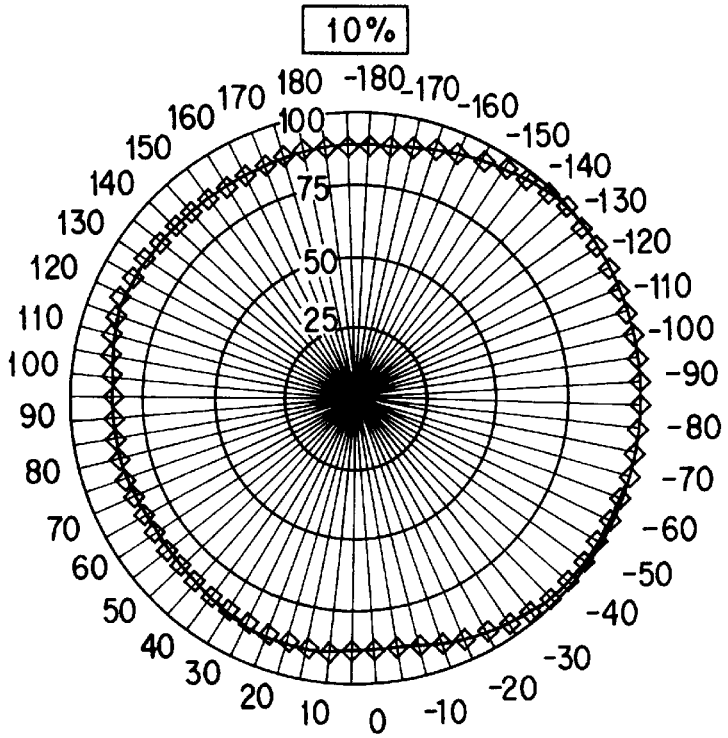
Figure 11A:
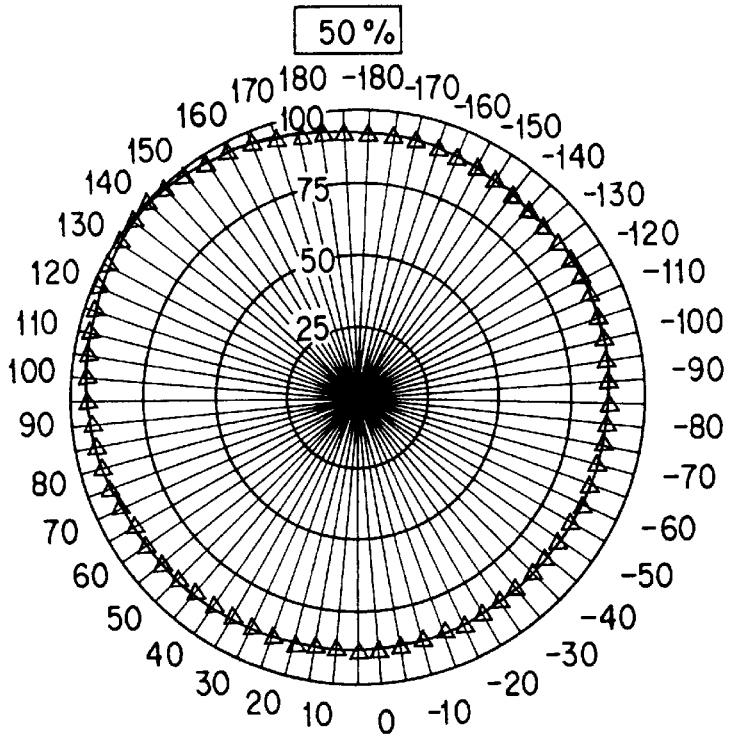
FIGS. 11A and 11B show data representing the light distribution.
Figure 11B:
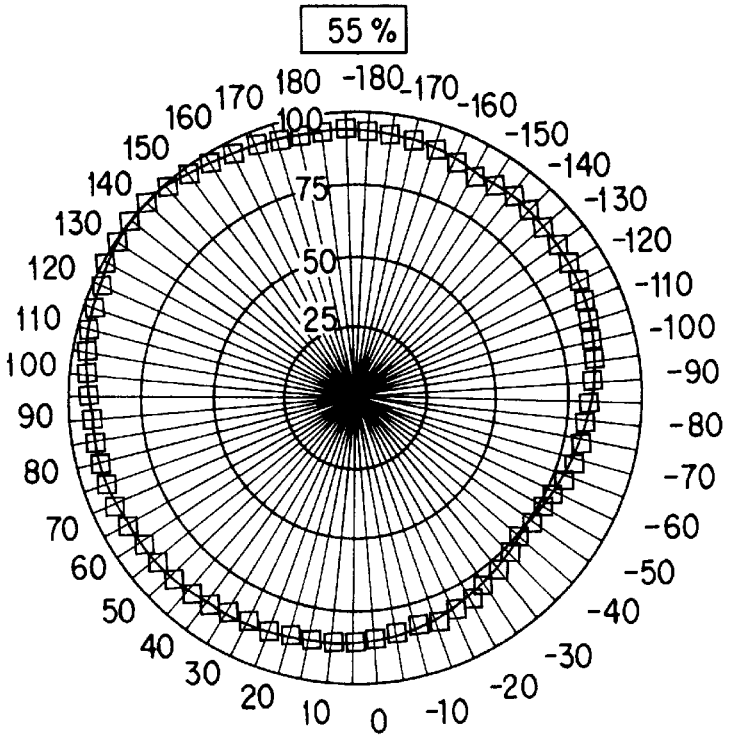
Figure 12:
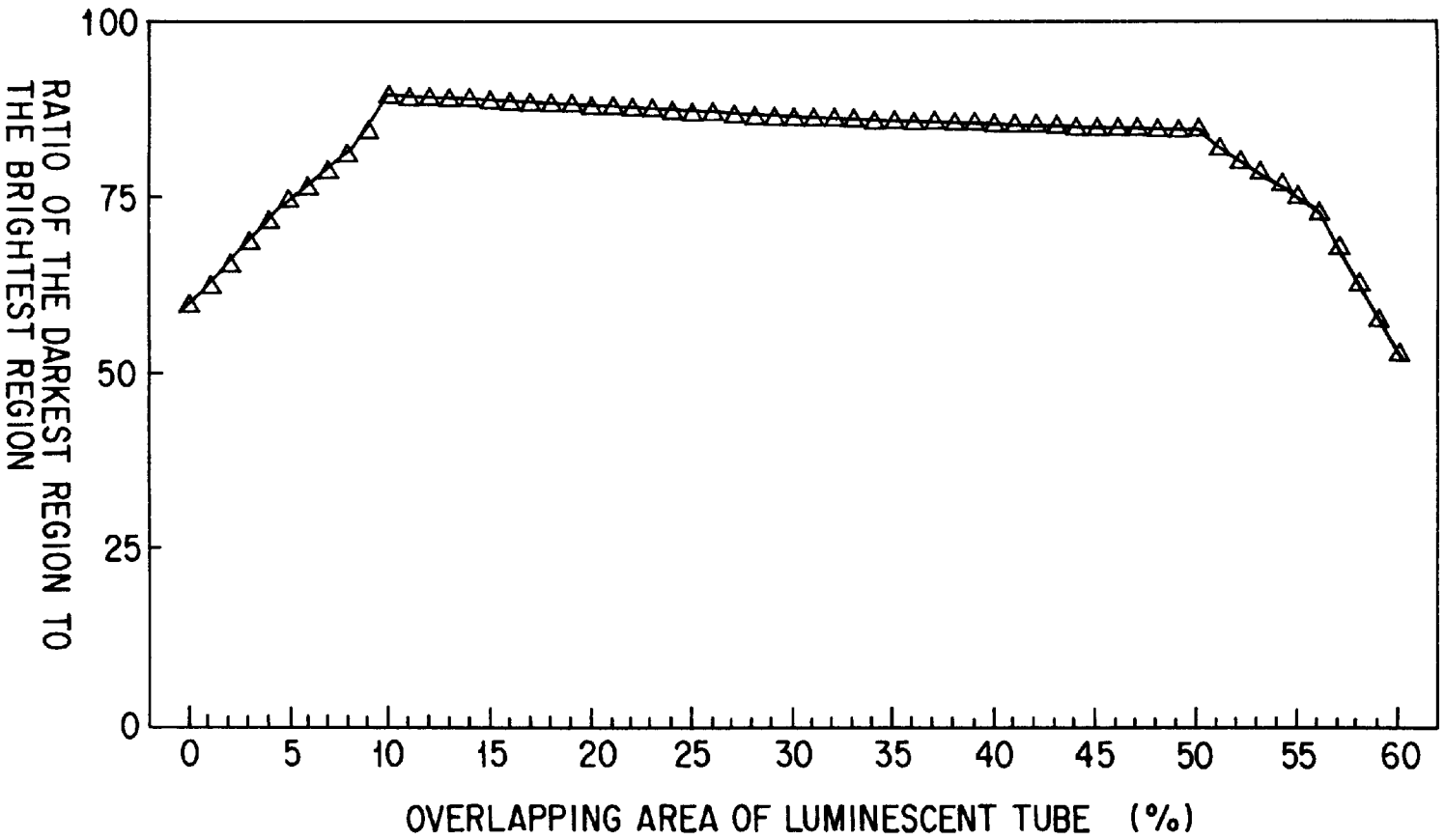
FIG. 12 is a graph showing the relationship between the overlapping area of the luminescent tubes and the ratio of the darkest region to the brightest region.

As shown in FIG. 9, the luminescent tubes 4A and 4B overlap each other. The ratio of the overlapping area A of the tubes 4A and 4B to the longitudinal sectional area of either luminescent tube may be given in percentage. FIG. 10A shows the data representing how the lamp distributes light when the ratio of the area A to the longitudinal sectional area is 5%. FIG. 10B shows the data representing how the lamp distributes light when the ratio of the area A to the longitudinal sectional area is 10%. FIG. 11A shows the data representing how the lamp distributes light when the ratio of the area A to the longitudinal sectional area is 50%. FIG. 11B shows the data representing how the lamp distributes light when the ratio of the area A to the longitudinal sectional area is 55%. FIG. 12 illustrates the relationship between the overlapping area A and the ratio of the darkest region to the brightest region.

With the present invention, when one luminescent tube goes off in a case that electric power fails for a moment during lighting, the other luminescent tube that has been unlighted and has a lower internal pressure comes on as soon as the power failure is corrected. At that time, the other luminescent tube has been heated during the time when one luminescent tube was on and has a little raised internal pressure, so that it reaches the stable lighting state in a short time.

Therefore, the time required to restart the lamp is very short. Use of lamps of this type for illuminating the road or the inside of the tunnel increases safety because the lighting recovers in a short time, even if the lamp goes off for a moment.

While in the embodiments, the high-pressure sodium lamp in which two luminescent tubes of the same type and ratings are sealed has been explained as a high-pressure discharge lamp, a lamp in which two luminescent tubes of the same type, such as metal halide lamps or high-pressure mercury lamps, or two luminescent tubes of different types are sealed, may be used.

Specifically, in scene lighting that illuminates buildings or trees or stage lighting, a lot of high-pressure discharge lamps are used to enhance the stage effects of lighting, so the cost of equipment piles up and the installation space is great. To overcome these disadvantages, an attempt has been made to seal luminescent tubes differing in color temperature in a single external tube.

The present invention may be applied to these types of lamps. For instance, a straight luminescent tube of a high-pressure sodium lamp and a straight luminescent tube of a high-pressure mercury lamp may be arranged in a near-V shape in the same external tube so that the respective purposes may be achieved or the required luminescent color may be emitted. In this case, each luminescent tube may be provided with a turning-on circuit device.

The high-pressure discharge lamp of the present invention explained in the above embodiments are used as a lighting fixture A for use in the tunnel as shown in FIG. 9. In the figure, reference symbol B indicates a rectangular parallel-epipedic housing and R indicates a reflecting mirror provided in the housing B. The reflecting mirror is provided with a socket (not shown) in which a lamp L is set. D indicates a turning-on circuit device provided with a turning-on circuit such as a ballast, G a cover, such as cover glass, provided on the bottom surface of the housing B, and E, E fittings to, for example, the ceiling of the tunnel.

When installed in the tunnel, the lighting fixture A thus constructed not only makes less the generation of a shade by the unlighted luminescent tube, improving the light distribution characteristic but also shortens the blackout time because the other luminescent tube comes on even when one luminescent tube goes off during lighting, assuring traffic safety.

The present invention is not limited to the above-described embodiments. For instance, the proximate conductor may be wound around the outside face of the bulb of the luminescent tube. In the case where the metal members, such as the support wires, supporting the luminescent tubes are provided close to the luminescent tubes, the metal members may be also used as the proximate conductors. In this case, the separate conductors may be eliminated.

The starter provided in parallel with the luminescent tubes inside or outside the external tube is not restricted to the configuration in the embodiments. It may be other pulse generating means.

The external tube is not limited to a tube sealed with a stem at one end, and may be a tube pinch seal instead of using a stem. Furthermore, the external tube is not restricted to one end seal. It may be sealed at both ends and enable electric power to be supplied to the luminescent tubes from both ends.

Still furthermore, the configuration of the lighting fixture is not limited to that in the embodiments. The lighting fixture may have another configuration.

What is claimed is:

1. A high-pressure discharge lamp comprising:

an external tube; and two luminescent tubes arranged substantially parallel to each other and to the external tube and which extend in the tube axis direction in such a manner that one tube twists with respect to the other or vice versa and which are close to each other at least at one end of each tube and are more separate in the middle of the tubes than the ends close to each other.

2. A high-pressure discharge lamp according to claim 1, wherein the proximate portions of the two luminescent tubes are crossed each other in a position where the proximate portion of one luminescent tube is not beyond the tip of the electrode of the other luminescent tube and vice versa.

3. A high-pressure discharge lamp according to claim 1, wherein each of the luminescent tubes is provided with a proximate conductor whose polarity is opposite to that of the proximate conductor of the other luminescent tube.

4. A high-pressure discharge lamp according to claim 2, wherein each of the luminescent tubes is provided with a proximate conductor whose polarity is opposite to that of the proximate conductor of the other luminescent tube.

5. A high-pressure discharge lamp according to claim 3, wherein the luminescent tubes are each provided with a proximate conductor and the external tube includes a starter connected in parallel with the luminescent tubes.

6. A high-pressure discharge lamp according to claim 1, wherein the two luminescent tubes in the external tube are of the same type.

7. A high-pressure discharge lamp according to claim 2, wherein the two luminescent tubes in the external tube are of the same type.

8. A high-pressure discharge lamp comprising:

an external tube with a tube axis;

a first luminescent tube which is housed in the external tube and in which a discharge medium is sealed; and a second luminescent tube which is housed in the external tube and in which a discharge medium is sealed, wherein the second luminescent tube is provided so that the projected area corresponding to the portion differing from the first luminescent tube may be within the range of 10% to 50% of the maximum projected area of the first luminescent tube itself when the external tube is viewed in the vertical direction with respect to the tube axis after the external tube has been rotated once using the tube axis as the axis of rotation, and the first and second luminescent tubes are arranged substantially parallel to each other and to the external tube.

9. A high-pressure discharge lamp, comprising:

an external tube; and two luminescent tubes formed in the external tube and which extend in a tube axis direction, wherein each of said two luminescent tubes are positioned to be closer to each other at at least one end than at a middle position, and said two luminescent tubes are arranged substantially parallel to each other and to said external tube.

10. A high-pressure discharge lamp according to claim 9, wherein the two luminescent tubes are crossed only at said at least one end and are of a same type of luminescent tube.

* * * * *